US007741573B2

(12) United States Patent
Masuda et al.

(10) Patent No.: US 7,741,573 B2
(45) Date of Patent: Jun. 22, 2010

(54) PUSH SWITCH

(75) Inventors: Masahiro Masuda, Okayama (JP); Yasunori Yanai, Okayama (JP); Yoshikazu Yagi, Okayama (JP)

(73) Assignee: Panasonic Corporation, Osaka (JP)

( * ) Notice: Subject to any disclaimer, the term of this patent is extended or adjusted under 35 U.S.C. 154(b) by 294 days.

(21) Appl. No.: 11/854,033

(22) Filed: Sep. 12, 2007

(65) Prior Publication Data

US 2008/0210535 A1 Sep. 4, 2008

(30) Foreign Application Priority Data

Sep. 13, 2006 (JP) ..... 2006-247722

(51) Int. Cl.
*H01H 5/30* (2006.01)

(52) U.S. Cl. ..... 200/406; 200/516

(58) Field of Classification Search ..... 200/406, 200/516

See application file for complete search history.

(56) References Cited

U.S. PATENT DOCUMENTS

| | | | | |
|---|---|---|---|---|
| 4,588,877 | A * | 5/1986 | Mizuta et al. | 200/406 |
| 6,114,644 | A * | 9/2000 | Nishikawa | 200/406 |
| 6,180,903 | B1 * | 1/2001 | Chen | 200/406 |
| 6,262,383 | B1 * | 7/2001 | Nishikawa | 200/406 |
| 6,392,177 | B1 * | 5/2002 | Zhang et al. | 200/406 |
| 6,495,783 | B2 * | 12/2002 | Rochon et al. | 200/406 |
| 6,756,554 | B1 * | 6/2004 | Hu | 200/406 |
| 6,815,628 | B2 * | 11/2004 | Okita et al. | 200/406 |
| 7,022,928 | B2 * | 4/2006 | Watanabe et al. | 200/406 |
| 7,157,650 | B2 * | 1/2007 | Rochon | 200/1 B |
| 7,449,654 | B2 * | 11/2008 | Tsuduki | 200/406 |
| 7,525,059 | B2 * | 4/2009 | Masuda et al. | 200/406 |

FOREIGN PATENT DOCUMENTS

| | | |
|---|---|---|
| CN | 1581389 A | 2/2005 |
| CN | 1738925 A | 2/2006 |
| JP | 05-001126 | 1/1993 |
| JP | 5-83958 U | 11/1993 |
| JP | 11-039987 | 2/1999 |

* cited by examiner

*Primary Examiner*—Michael A Friedhofer
(74) *Attorney, Agent, or Firm*—RatnerPrestia

(57) ABSTRACT

An operating body being made of a metal plate and being overlaid with polyamide resin layer, a side of the operating body having an operating part protruding from a front side of a switch case, and an other side having a driving part in an arm shape and a sliding guide in a frame shape surrounding the driving part, in which the driving part in the arm shape being compression pressed to be a thin plate, and the sliding guide being formed with an upper sliding contact in a hemisphere shape coming into contact with an undersurface of cover above the contact and a lower sliding contact formed long in back and forth direction coming into contact with a protective sheet under the contact.

6 Claims, 7 Drawing Sheets

PUSH SWITCH

FIELD OF THE INVENTION

The invention relates to a push switch to be used for an input operating part of a variety of electronic devices, the push switch to be operated horizontally in parallel with a wiring substrate of the device.

BACKGROUND OF THE INVENTION

As multi-functional electronic devises become popular, a compact and slim type electronic device is demanded as exemplified by a portable phone, and a switch having a light and comfortable touch feeling is widely used for various electronic devices, many mounted on a side of the devices.

A conventional push switch used in the electronic devices is explained with referenced to FIGS. 7 to 10. FIG. 7 is a cross sectional view of a conventional push switch; FIG. 8 is an exploded perspective view of the conventional push switch; FIG. 9 is a cross sectional view showing an operation status of the conventional push switch; and FIG. 10 is a side view of the conventional switch showing its mounting status.

As shown in FIGS. 7 to 10, the conventional push switch includes switch case 101 made of insulating resin in a square shape having upper opening 101A and concavity 101B in substantially a round shape recessed from a bottom plane of upper opening 101A. Inside a bottom plane of concavity 101B, center fixed contact 102 is disposed at its central part and a pair of outer fixed contacts 103 disposed at an outer parts of the concavity by insertion molding symmetrically with respect to center fixed contact 102. Terminals 104 and 105 are drawn out of a side wall of switch case 101 connected to center fixed contact 102 and outer fixed contacts 103.

Movable contact 106 made of an elastic thin metal plate formed in an uplifted round dome shape is placed on outer fixed contact 103 with its lower peripheral part put on the fixed contact. Flexible protective sheet 107 of an insulating resin film is attached to the bottom plane of upper opening 101A of switch case 101, covering an upper plane of concavity 101B which contains movable contact 106.

On protective sheet 107, operating body 108 is placed in a horizontally movable manner in back and forth direction. Operating body 108 has operating part 108A extended from a front side outer wall of switch case 101, driving part 108B which is elastically deformable and formed in a bar shape having pressing part 108C which has a tip extended toward a center portion of upper opening 101A of switch case 101, and sliding guide 108E in a flat shape surrounding driving part 108B through notch 108D in substantially a U-shape, and they are all one piece resin molded.

The conventional push switch includes cover 109 of a metal plate, fixed to switch case 101, covering operating body 108 and restricting an upward movement of operating body 108. Cover 109 is put on switch case 101, closing upper opening 101A of switch case 101. Cover 109 is engaged with two outside walls of switch case 101 crossing an other outside wall at right angles where terminals 104 and 105 are extended. Namely, cover 109 has engaging parts 109A extended downward, one toward a front side wall where operating part 108A is positioned and an other toward an opposing rear side. Engaging part 109A is engaged with interlocking projection 101C formed in the walls, attaching the cover to switch case 101.

On an upper central portion of cover 109, a pair of slits 109B is formed, and a portion between the pair of slits 109B is obliquely bent down forming inclined part 109C. As cover 109 is installed on switch case 101, inclined part 109C of cover 109 is placed in notch 108D of operating body 108, in which an upper part of pressing part 108C as the tip of driving part 108B of operating body 108 comes into contact with a front side plane of inclined part 109C.

The conventional push switch is thus constituted. Next, a working mechanism of the switch is explained.

First, when operating part 108A of operating body 108 is pushed forward, operating body 108 is horizontally moved to a rear side of the switch. Driving part 108B is then elastically deformed at its base part and its tip is sled obliquely downward along a slanted plane of inclined part 109C of cover 109. Accordingly, pressing part 108C, the tip of driving part 108B pushes down a top portion of movable contact 106 in a dome-like shape through protective sheet 107. When downward pushing force of movable contact 106 exceeds a specified value, the dome-like top portion of movable contact 106 is elastically turned around generating a crisp feeling and pointing downward as shown in FIG. 9. Thus, an under center part of the movable contact 106 touches a top portion of center fixed contact 102, turning the switch on.

Following, when the push force applied to operating body 108 is released, the dome-like portion of movable contact 106 restores its original shape with a comfortable feeling, pointing upward. With this self-restoring power of movable contact 106, pressing part 108C that is the tip of driving part 108B is pushed upward. The tip of pressing part 108C moves back obliquely upward along inclined part 109C helped by a self-restoring power of elastically bent driving part 108B. As a result, operating body 108 is horizontally pushed back to a front side with sliding guide 108E sliding on protective sheet 107 adhered to upper opening 101A. Thus, the switch returns to the original off state, as shown in FIG. 7.

The conventional push switch operates when pushing operating part 108A of operating body 108 is horizontally pushed. The switch is generally mounted on wiring board 110 and soldered to wiring board 110 so as operating part 108A to protrude from an end portion of wiring board 110 as illustrated in FIG. 10.

As a prior art document related to the applied invention, Unexamined Japanese Patent Publication No. H11-39987 and Unexamined Japanese Utility Model Publication No. H5-1126 are publicly known, for examples.

The conventional push switch, as illustrated in FIG. 10, is attached in a state where operating part 108A is protruded from the end portion of wiring substrate 110. Because of this arrangement, operating part 108A protruded from the end of wiring substrate 110 may bump into or it may hook some object, applying an unexpected load or damaging operating part 108A.

To enhance strength of the operating part, the operating body can be made thicker, but it makes the push switch thicker going against a market requirement for thin type product.

SUMMARY OF THE INVENTION

The push switch of this invention includes a switch case made of insulating resin, a movable contact made of a thin elastic metal plate, an operating body made of a metal plate, and a cover made of a metal plate. The switch case of insulating resin has an upper opening, a center fixed contact and an outer fixed contact are disposed at inside bottom of a concavity. The movable contact of the thin elastic metal plate is in a dome shape and a lower end of an outer peripheral part thereof is placed on the outer fixed contact.

The operating body of the metal plate includes polyimide resin layer on its upper side, the operating part at its one end, and being protruded from a front side of the switch case; and the deformable elastic driving part in an arm shape and a sliding guide of a flat plate surrounding the driving part inward on the other side. The operating body is movable in a horizontal direction within the upper opening of the switch case.

The metal cover made of a metal plate has an inclined part in a central part thereof, which deforms a tip portion of the driving part elastically downward when the operating part of the operating body is pushed in the horizontal direction. The metal cover is attached so as to close the upper opening of the switch case from above the operating body.

In this constitution, because the operating body is made of a metal plate and is overlaid with a resin layer, metallic friction between the operating body and the cover is reduced, realizing a smooth horizontal movement of the operating body. The metal plate enhances a mechanical strength of the operating body and reduces a thickness of the body, easily realizing a thin type push switch.

DETAILED DESCRIPTION OF PREFERRED EMBODIMENT

Below, a preferred embodiment of the invention is explained with reference to the drawings.

Preferred Embodiment

Figure 1:
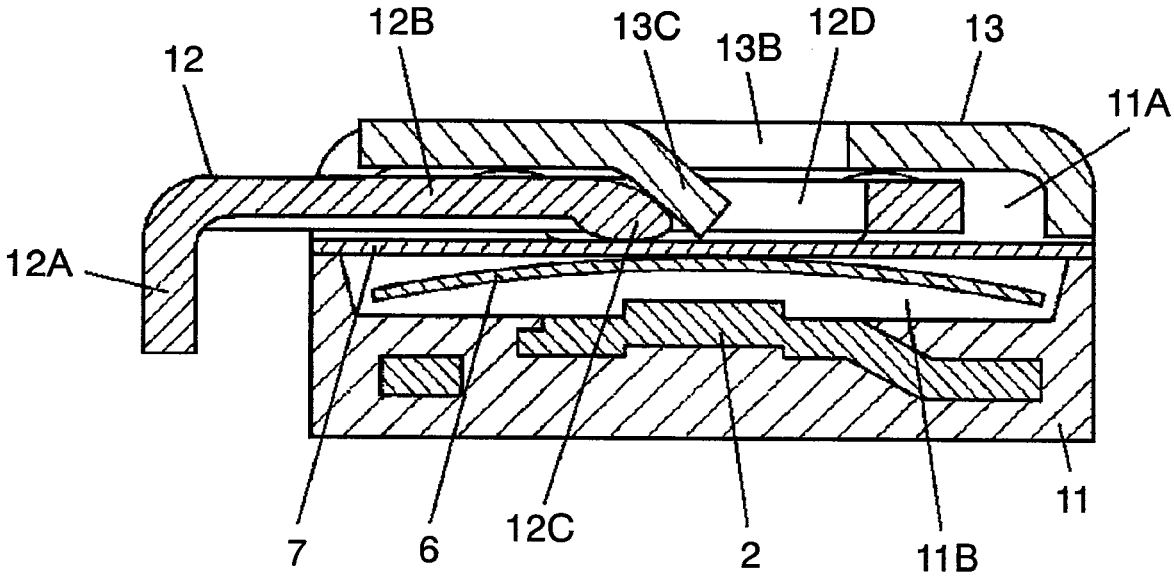
FIG. 1 is a cross sectional view of a push switch in accordance with a preferred embodiment of the invention.
Figure 2:
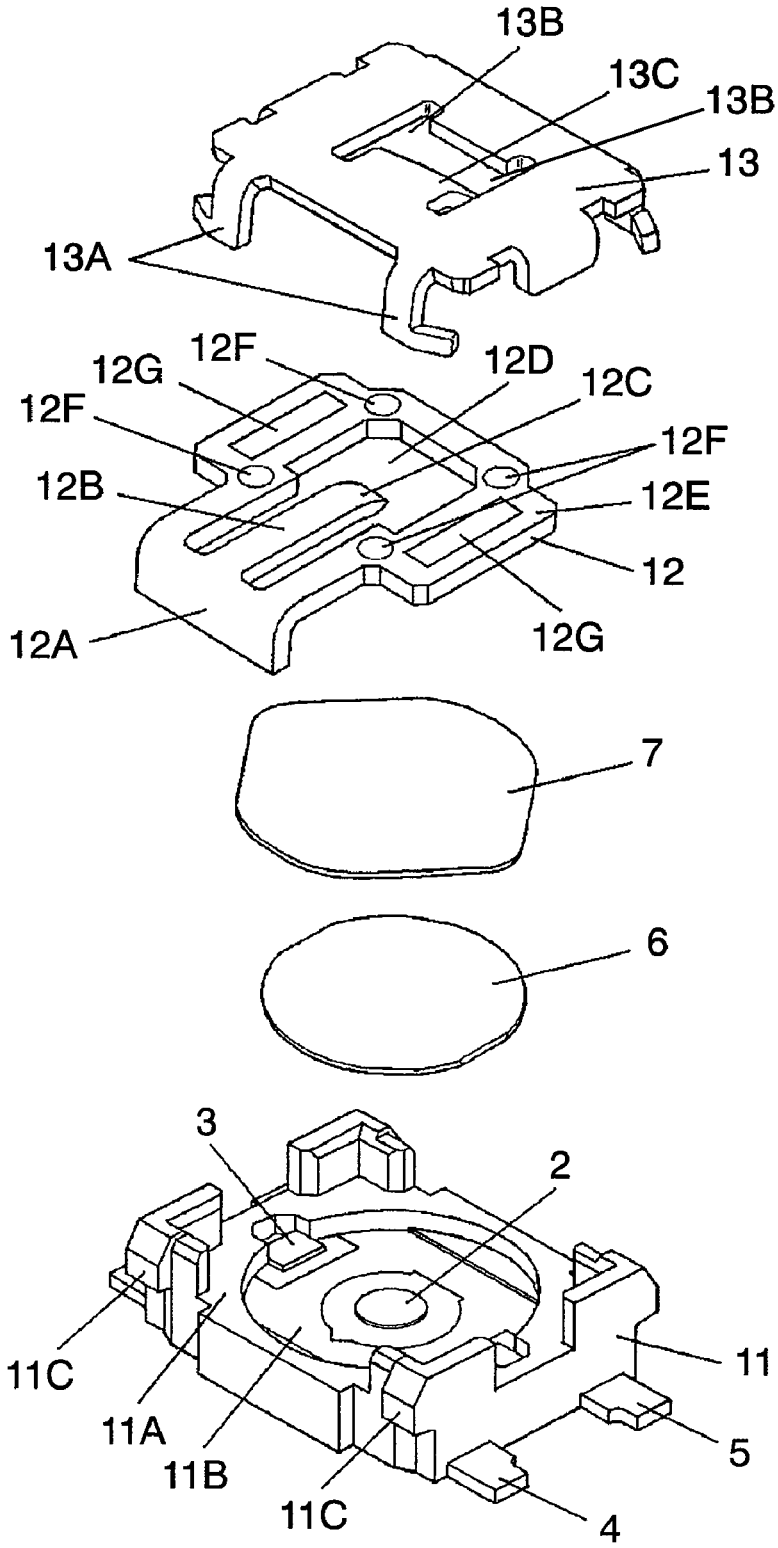
FIG. 2 is an exploded perspective view of the push switch.
Figure 3:
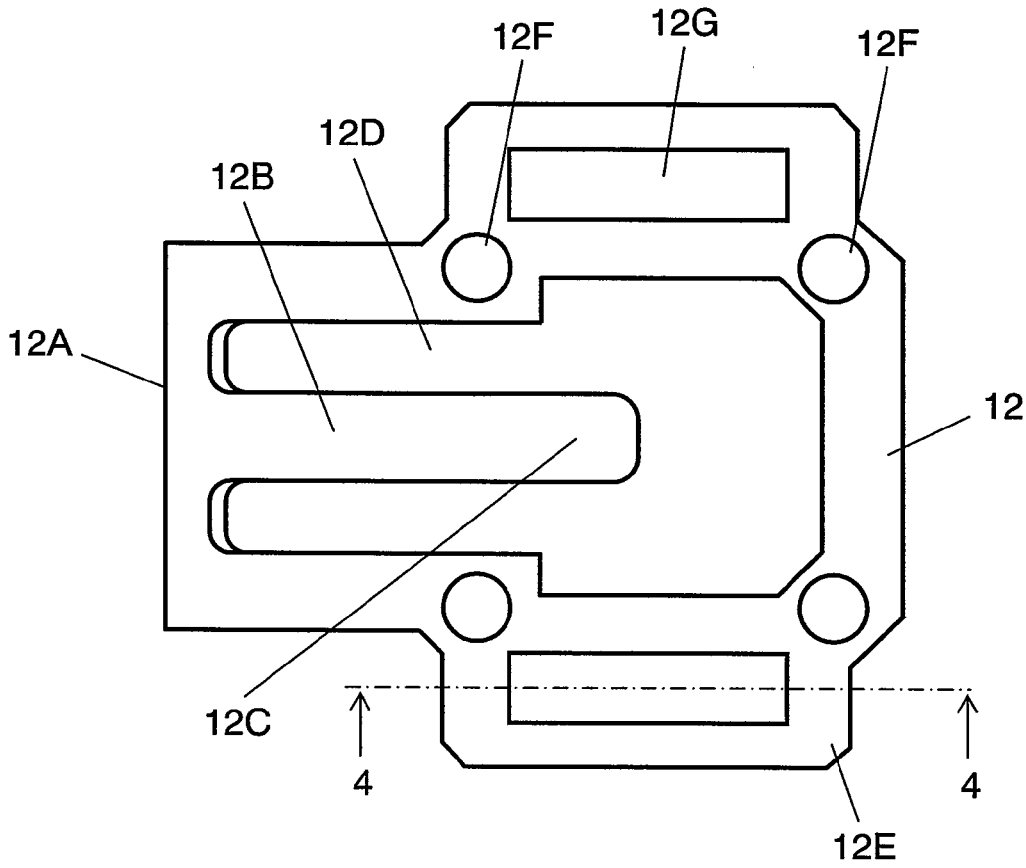
FIG. 3 is a plain view of an operating body of the switch.
Figure 4:
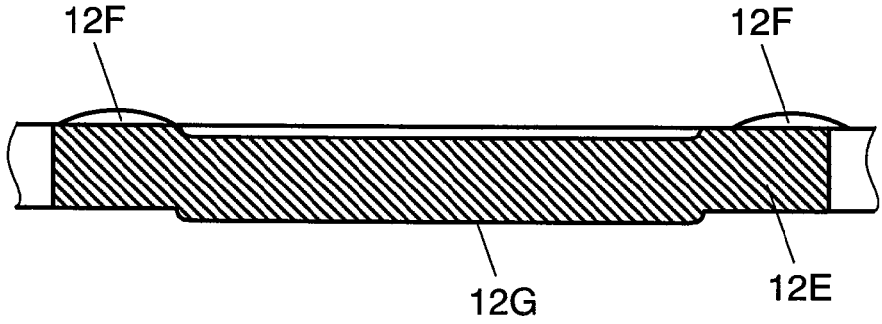
FIG. 4 is a cross sectional view in line with 4 to 4 in FIG. 3.
Figure 5:
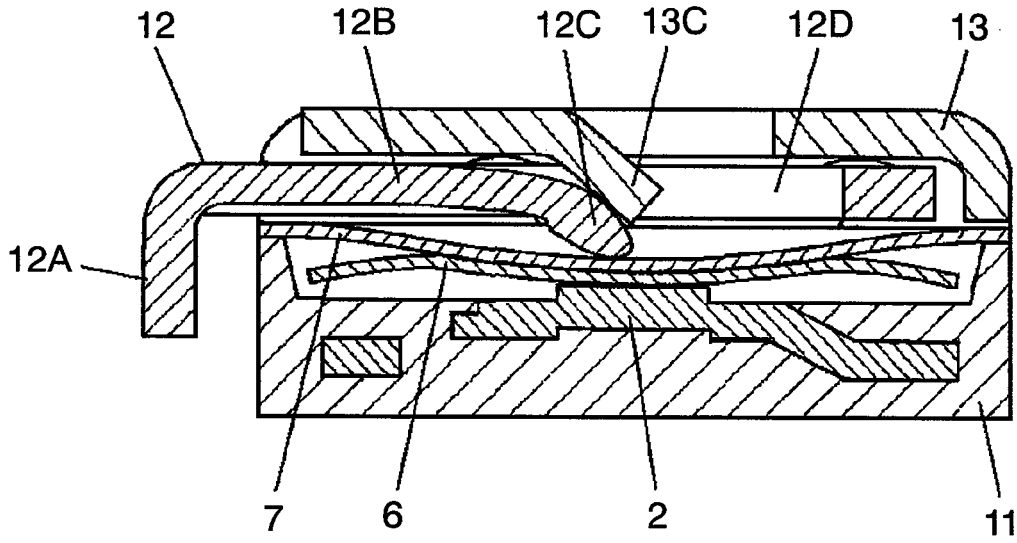
FIG. 5 is a cross sectional view showing a working status of the push switch.
Figure 6:
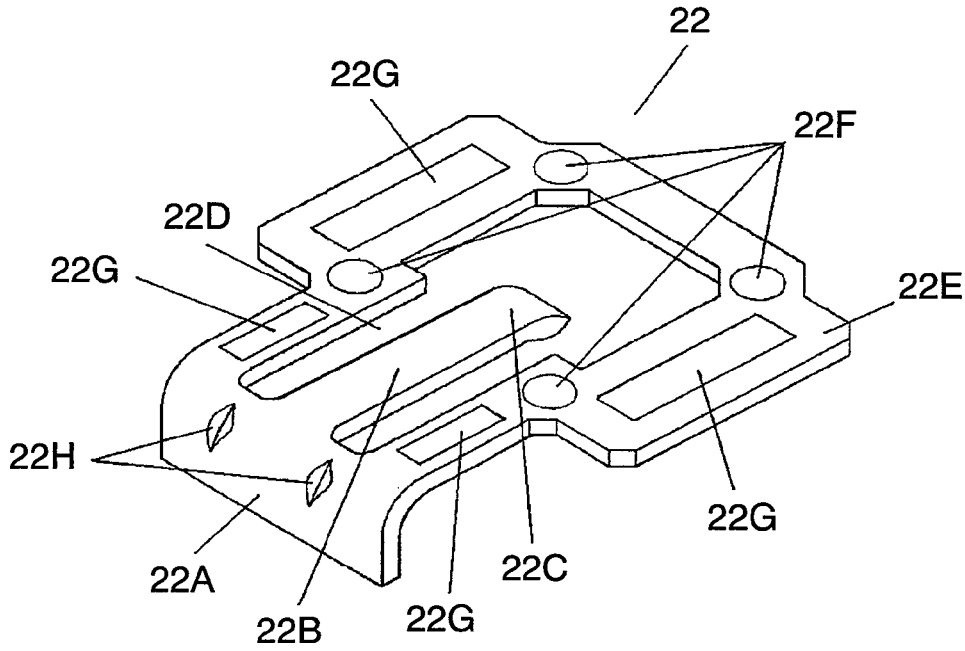
FIG. 6 is an external view of an operating body of other preferred embodiment.
Figure 7:
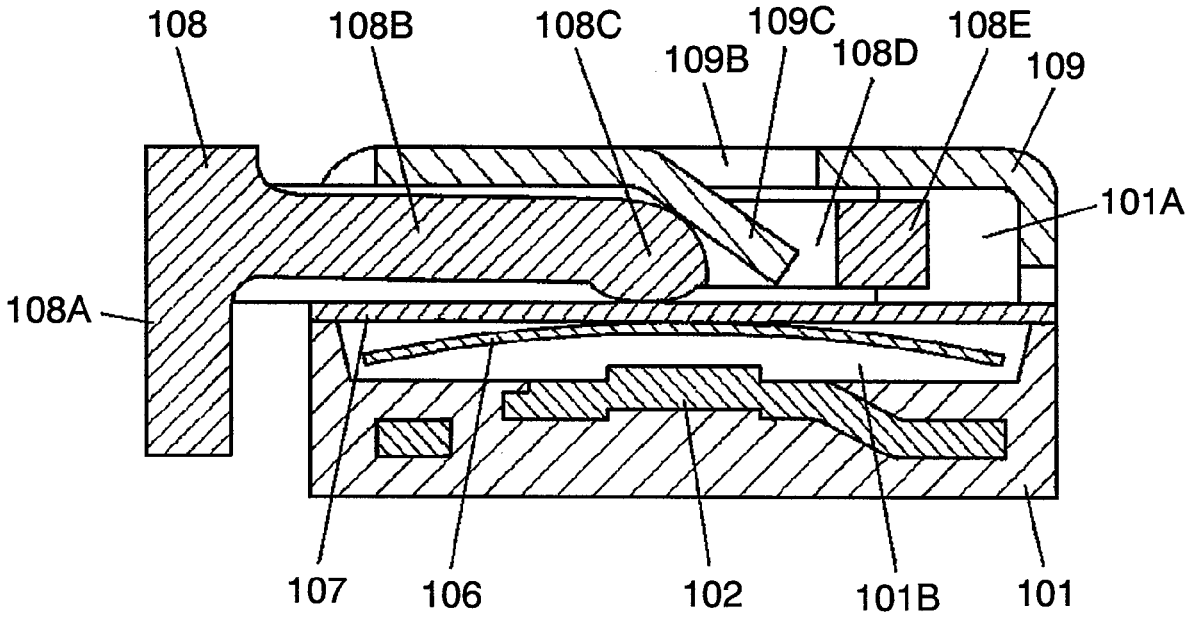
FIG. 7 PRIOR ART
FIG. 7 is a cross sectional view of a conventional push switch.
Figure 8:
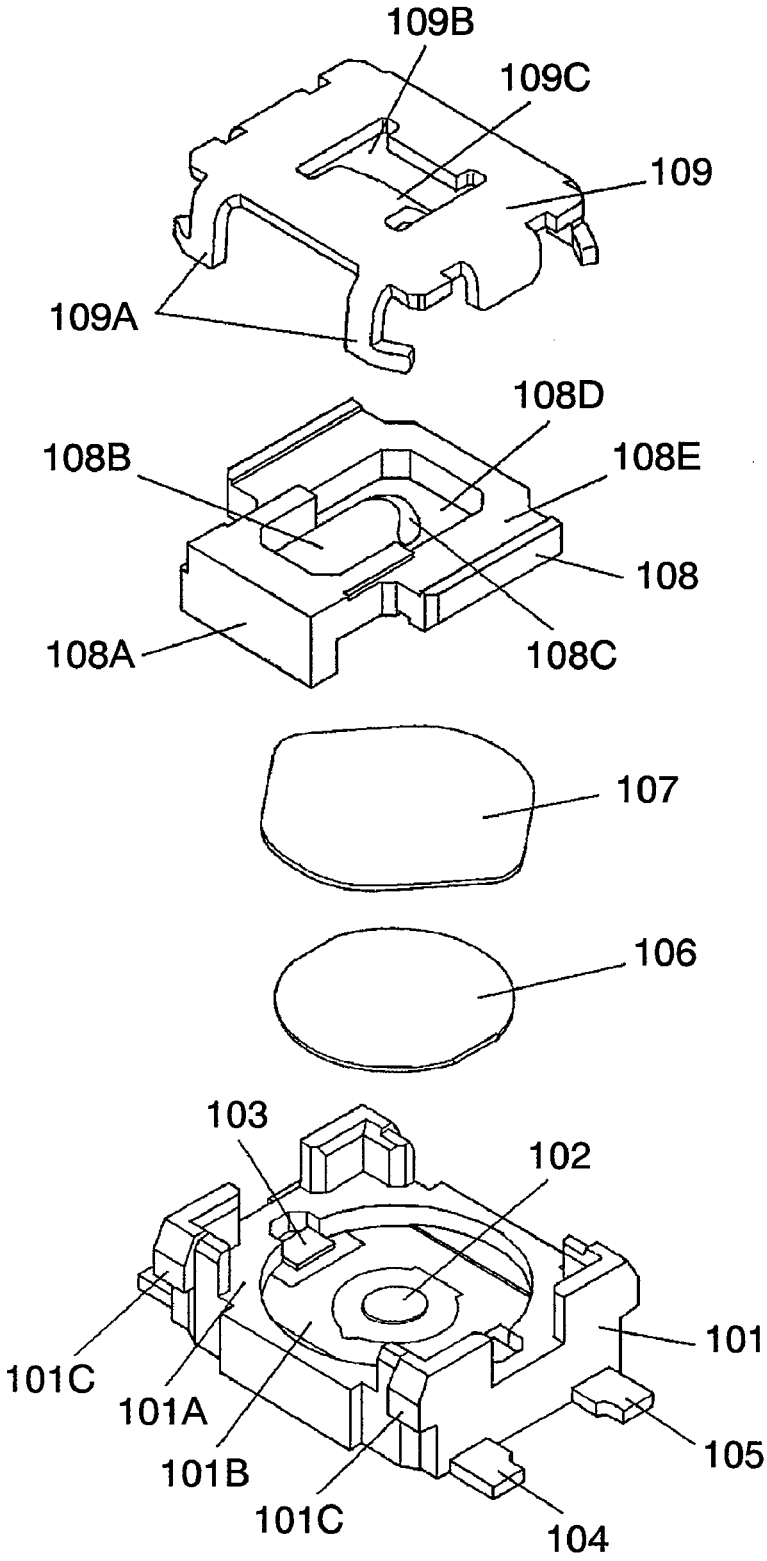
FIG. 8 PRIOR ART
FIG. 8 is an exploded perspective view of the conventional push switch.
Figure 9:
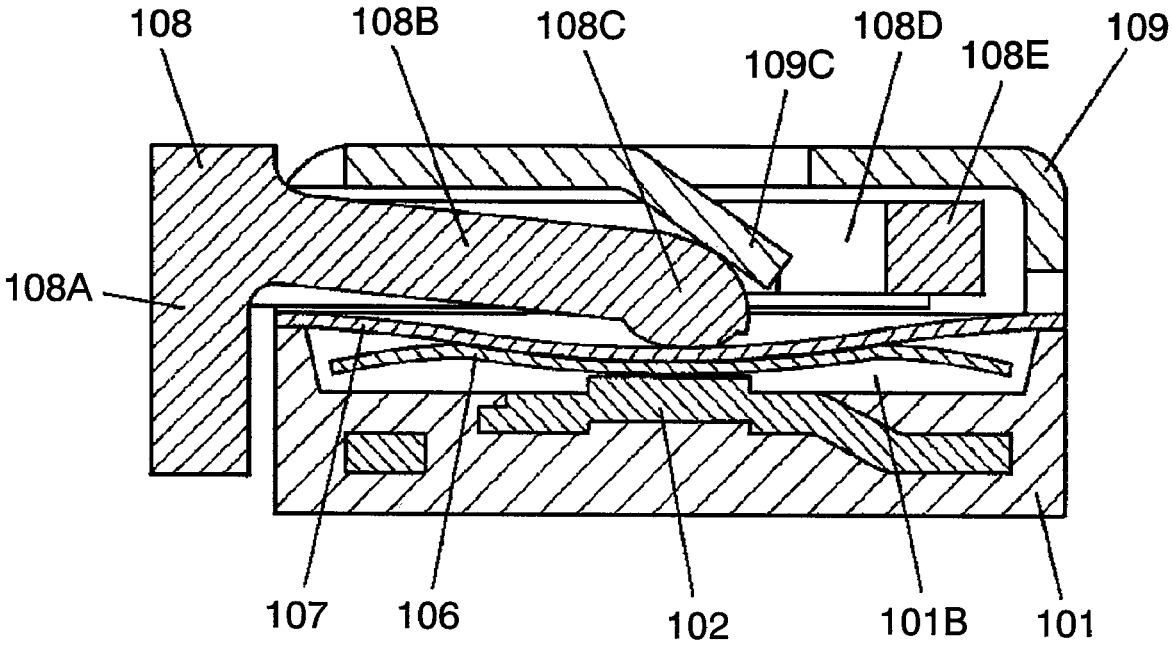
FIG. 9 PRIOR ART
FIG. 9 is a cross sectional view showing an operating status of the conventional push switch.
Figure 10:
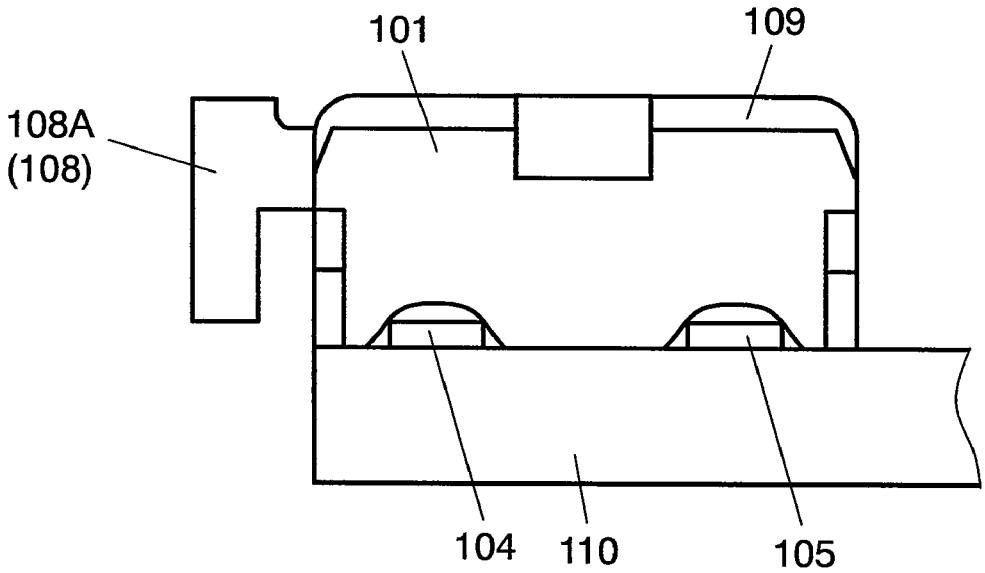
FIG. 10 PRIOR ART
FIG. 10 is a side view of the conventional switch showing a mounting status of it.

FIG. 1 is a cross sectional view of a push switch in accordance with a preferred embodiment of the invention; FIG. 2 is an exploded perspective view of the push switch; FIG. 3 is a plain view of an operating body of the switch; FIG. 4 is a cross sectional view in line with 4 to 4 in FIG. 3; FIG. 5 is a cross sectional view showing a working status of the push switch; and FIG. 6 is an external view of an operating body of other preferred embodiment.

As shown in FIGS. 1 and 2, the push switch according to the preferred embodiment of the invention includes switch case 11 made of insulating resin formed in substantially a square shape, having concavity 11*b* in substantially a round shape and formed hollowed from a bottom plane of upper opening 11A. Inside bottom plane of concavity 11B, center fixed contact 2 and a pair of outer fixed contacts 3 is disposed, the outer fixed contacts 3 being disposed at an equal distance from center fixed contact 2. Terminal 4 and terminals are respectively connected to center fixed contact 2 and outer fixed contacts 3, and both are extruded from a side wall of switch case 11.

Movable contact 6 made of a thin elastic metal plate in an uplifted dome shape is disposed in concavity 11B with its lower outer peripheral part put on outer fixed contact 3.

Flexible protective sheet 7 made of an insulating resin film is adhered to a bottom plane of upper opening 11A namely an upper plane of concavity 11*b* with an adhesive applied to an undersurface of the protective sheet, closing concavity 11B.

On protective sheet 7, operating body 12 is placed. In one end, operating body 12 has operating part 12A extending from a front side outer wall of switch case 11. On an other side, operating body 12 has elastically deformable driving part 12B in an arm-shape placed in switch case 11 as well as sliding guide 12E surrounding driving part 12B through notch 12D in substantially a U-shape. Operating body 12 is placed in upper opening 11A of switch case 11 in a horizontally movable manner in back and forth direction. As is shown in FIG. 1, when operating body 12 is in non-operation, pressing part 12C at a tip of driving part 12B is positioned above movable contact 6 in switch case 11.

Cover 13 made of a metal plate is fixed to switch case 11, covering and restricting upward movement of operating body 12. Cover 13 has a pair of slits 13B formed in a central part of an upper flat plane of the cover. A portion in-between the pair of slits 13B is bent obliquely downward, forming inclined part 13C. Since cover 13 has inclined part 13C at its central part, an inclined plane bends pressing part 12C as a tip portion of driving part 12B elastically downward when operating part 12A of operating body 12 is horizontally pressed. Cover 13 is attached so that operating body 12 to cover upper opening 11A of the switch case 11. Engaging parts 13A are extended downward from each side of the cover and are engaged with interlocking projections 11C formed on two outside walls facing each other and crossing an other outside wall at right angles where terminal 4 and terminal 5 are extended.

With the push switch according to the preferred embodiment, the metal plate of operating body 12 is coated with a 0.01 mm to 0.02 mm thick polyimide resin layer. Operating body 12 of the switch is made thinner than a conventional operating body made of insulating resin. Although the operating body made of conventional insulating resin is 0.44 mm thick, operating body 12 of the preferred embodiment made of stainless steel plate or phosphor bronze plate is 0.2 mm thick. Material of operating body 12 is not limited to the mentioned material and other material can well be utilized as long as it satisfies a specified mechanical strength, has a good processability and does not cause a cost increase.

Further, as shown in FIGS. 1 to 3, operating part 12A of operating body 12 extending from the front side of the switch case 11 is bent 90 degree downward. The operating part 12A has a plain part with an enough dimension to absorb a fitting discrepancy for an operating button of an electronic device (not-illustrated).

Moreover, arm-shape driving part 12B of operating body 12 is made thin by cold casting or other compression method and is elastically deformable, except for pressing part 12C formed at the tip of driving part 12B as the tip portion in substantially an arcuate shape. On an upper side of sliding guide 12E, upper sliding contact 12F in a hemisphere shape is formed in four places corresponding to a corner space of square switch case 11. On an underside of a pair of sliding guides made in parallel with the back and forth operational direction, lower sliding contacts 12G are formed long in back and forth direction, as shown in FIG. 4. The sliding contacts are coming into contact with an upper surface of protective sheet 7 sustained by a bottom surface of upper opening 11A of switch case 11. With the preferred embodiment, thickness of the protrusion of upper sliding contact 12F and lower sliding contact 12G is 0.03 mm. Since 0.2 mm thick stainless steel plate or phosphor bronze plate is used as operating body 12, total thickness of operating body 12 is 0.26 mm after forming the contacts.

The push switch according to the invention is constituted as above. Next, operational mechanism of the switch is explained. First, when operating part 12A of operating body 12 is horizontally pushed forward, operating body 12 horizontally moves between protective sheet 7 and cover 13 toward a rear side. Accordingly, arm-shape driving part 12B is elastically deformed at middle thin portion, and pressing part 12C as the tip portion of the operating body moves downward obliquely along a slanted plane of inclined part 13C of cover 13. Consequently a dome-like top portion of movable contact 6 is pressed down through protective sheet 7. When downward press force exceeds a certain specified value, the dome-like portion of movable contact 6 is elastically turned around generating a comfortable feeling and the top portion pointing downward, as it is shown in FIG. 5. Thus, an under part of a central part of the movable contact touches center fixed contact 2, turning the switch on.

Following, when the press force applied to operating part 12A of operating body 12 is released, the dome-like portion of movable contact 6 restores its original shape, pointing upward. Pressing part 12C is therewith pushed upward obliquely along inclined part 13C of cover 13. As elastically deformed arm-shape driving part 12B comes back to its original shape, operating body 12 comes back to the front side of the switch, returning the switch to the original off state, as shown in FIG. 1.

With this switch of the preferred embodiment, the dome-like portion of movable contact 6 turns around and restores its original shape by generating a comfortable switching feeling. However, since protective sheet 7 is overlaid on movable contact 6, movable contact 6 does not directly bump pressing part 12C at the tip of driving part 12B of operating body 12. Therewith, unusual sound emission to be caused by collision of metals is prevented. Furthermore, since protective sheet 7 covers concavity 11B of switch case 11 wherein contact points are constituted, dust invasion into concavity 11B is prevented. With such arrangements, reliability of center fixed contact 2, outer fixed contact 3 and movable contact 6 is secured.

Operating body 12 sidably moves back and forth between the lower plane of cover 13 and the upper surface of protective sheet 7 adhered to the bottom of upper opening 11A of switch case 11. However, as contact dimension is reduced with upper sliding contact 12F and lower sliding contact point 12G formed with sliding guide 12E, a smooth operational feeling is produced.

The upper surface of operating body 12 is covered with a polyimide resin layer, so even though operating body 12 and cover 13 are made of metallic material, the metals do not rub directly each other, achieving a smooth movement of operating body 12.

Since the resin layer is formed with polyamide, it further gives a heat resistance against soldering to this surface mount type switch of the preferred embodiment.

Moreover, since operating body 12 is made of a metal plate, operating part 12A has a mechanical strength against a damaging force, even when the plate is thin. Driving part 12B is formed thin except for pressing part 12C which is formed its tip; 0.2 mm thick material of driving part 12B is processed into 0.15 mm, for an example. Driving part 12B is thus made elastically bendable for pressing operation, without sacrificing the dome-like portion of movable contact 6 to be elastically reversed or self-restored with a comfortable feeling.

FIG. 6 is a perspective view of an operating body made of a much thinner metal plate than operating body 12 shown in FIG. 3. As shown in FIG. 6, one end of operating body 22 has operating part 22A extending out of a front wall of switch case 11 with its end portion being bent downward. Operating part 22A also has elastically deformable driving part 22B having pressing part 22C which is the tip of driving part 22B and is positioned above movable contact 6, and sliding guide 22E surrounding driving part 22B through notch 22D in substantially a U-shape.

On an upper surface of sliding guide 22E, upper sliding contacts 22F in a hemisphere shape are protruded in four places corresponding to corner portions of switch case 11. On an undersurface of the sliding guide, four lower sliding contact pints 22G are formed protruding long in back and forth direction in parallel with the back and forth operational direction of the operating body, two between upper sliding contacts 22F at each side of the body and other two in parallel with arm-shape driving part 22B. Upper sliding contacts 22F and lower sliding contacts 22G are formed for smoothing sliding movement of operating body 22 in back and forth direction as well as for reinforcing parts against the thin operating body 22.

In addition to the sliding guides, the operating body 22 has a plurality of slots 22H carved on a bent portion of the body in vertical with a bent line, the bent portion as the reinforcing parts of operating part 22A. Operating part 22A is thus reinforced with carved slots 22H.

Thickness in a middle part of arm shape driving part 22B is equal to or thinner than already mentioned thin driving part 12B in FIG. 3. The thickness of the material is 0.1 mm to 0.15 mm, so it is easy to bend the part elastically as it is without processing.

Constitution and working mechanism of the push switch using operating body 22 is identical to that of already mentioned one so the explanation is omitted. A difference is that because operating body 22 is thinner the push switch is correspondingly thinner.

As described, the sliding contact is composed of upper sliding contact 12F or 22F in a hemisphere shape, or lower sliding contact 12G or 22G long in shape in back and forth direction. Operating body 12, 22 include the sliding contacts protruded upward at an upper surface of the guide 12E or 22E, and the sliding contacts protruded downward at an under surface thereof. Thus, sliding dimension of operating body 12 or 22 during an operation is reduced and a smooth sliding feeling is obtained.

What is claimed is:

1. A push switch comprising:

a switch case having an upper opening;

a movable contact formed in a dome shape protruding towards the upper opening;

an operating body being made of a metal plate including:

polyimide resin layer on an upper side of the operating body;

an operating part protruding from a front side of the switch case;

a deformable elastic driving part in an arm shape having a tip portion; and a sliding guide surrounding an outer edge of the driving part, the operating body movable in a horizontal direction in the upper opening of the switch case; and a metal cover having an inclined part in a central part thereof, the inclined part deforming the tip portion of the driving part elastically downward when the operating part of the operating body is pushed in the horizontal direction.

2. A push switch according to claim 1, further comprising:

a flexibly bendable protective sheet made of an insulating film and having an adhesive at its lower surface, wherein the protective sheet extends between the movable contact and the operating body and is adhesively attached to a bottom plane of the upper opening.

3. A push switch according to claim 1, wherein the driving part of the operating body excluding the tip portion has a thickness of at most 0.2 mm.

4. A push switch according to claim 1, wherein a reinforcing part is formed at the sliding guide and the operating part of the operating body.

5. A push switch according to claim 1, wherein the operating body includes a first sliding contact protruding upward from an upper surface of the sliding guide and a second sliding contact protruding downward from a lower surface of the sliding guide.

6. A push switch comprising:

a switch case having an upper opening;

a metal cover having an inclined part in a central part thereof; and an operating body including:

an operating part protruding from a front side of the switch case;

a deformable elastic driving part in an arm shape having a tip portion; and a sliding guide surrounding an outer edge of the driving part, the sliding guide including a first rounded sliding contact protruding from an upper surface of the sliding guide and a second straight sliding contact protruding from a lower surface of the sliding guide, the operating body movable in a horizontal direction between the upper opening of the switch case and a lower plane of the metal cover, wherein the inclined part deforms the tip portion of the driving part elastically downward when the operating part of the operating body is pushed in the horizontal direction.

* * * * *